US005103593A

United States Patent [19]

McNaughton

[11] Patent Number: 5,103,593

[45] Date of Patent: Apr. 14, 1992

[54] DOOR SHIELD CONSTRUCTION

[76] Inventor: Mark S. McNaughton, 4433 Saybrook La., Harrisburg, Pa. 17110

[21] Appl. No.: 751,133

[22] Filed: Aug. 28, 1991

[51] Int. Cl.[5] ..... E06B 3/30

[52] U.S. Cl. ..... 49/460

[58] Field of Search ..... 49/460, 50, 57, 501; 52/202, 506, 515

[56] References Cited

U.S. PATENT DOCUMENTS 3,147,176 9/1964 Haslam ..... 49/460 X
4,351,868 9/1982 Otani ..... 49/460 X
4,372,364 2/1983 Katz ..... 49/460 X
4,510,986 4/1985 Schwankl ..... 52/202 X

*Primary Examiner*—Philip C. Kannan
*Attorney, Agent, or Firm*—Leon Gilden

[57] ABSTRACT

A door shield is arranged for securement to an exterior surface of a dwelling door to afford temporary protection to the door during construction procedures thereabout. The organization includes a polymeric rear layer mounting an accordion pleated forward surface formed of parallel ribs to afford impact resistance to the door. Magnetic and adhesive members are coextensively formed at a rear perimeter of the door for adherence of the structure to the door.

6 Claims, 4 Drawing Sheets

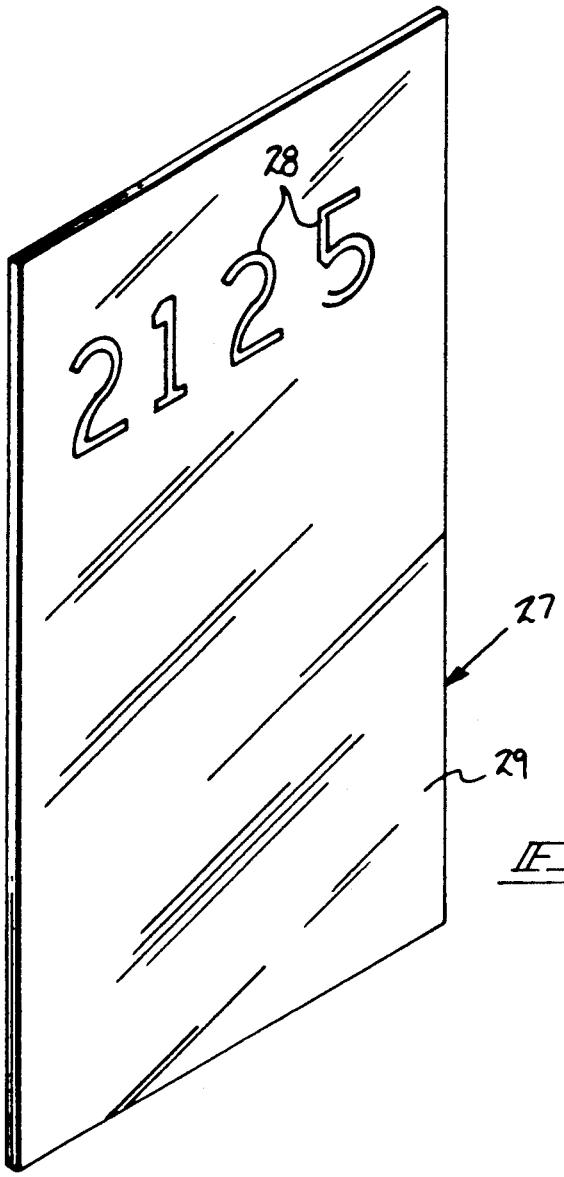
Fig 8
Fig 9
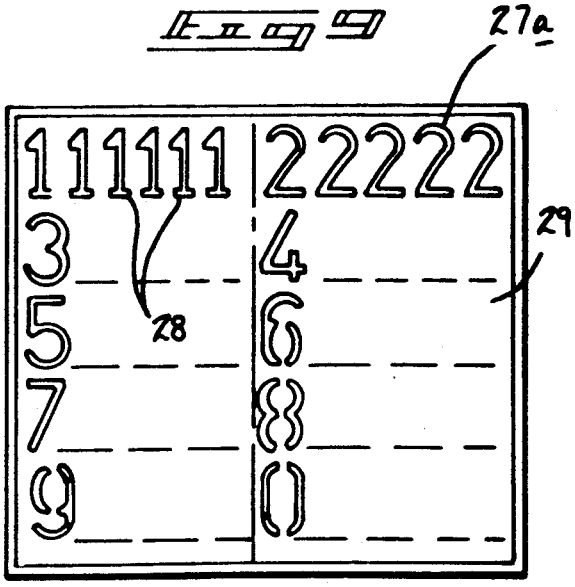

DOOR SHIELD CONSTRUCTION

BACKGROUND OF THE INVENTION

1. Field of the Invention

The field of invention relates to shield apparatus, and more particularly pertains to a new and improved door shield construction wherein the same is arranged for temporary adherence to an exposed surface of a door to afford protection from impact to the door relative to construction.

2. Description of the prior Art

Shield apparatus of various types is utilized in the prior art to afford protection to various surfaces. Examples of such devices are found and exemplified in U.S. Pat. No. 4,566,222 to Hatvany wherein a one-piece window or door guard is provided that is of a permanent construction latched and delatched relative to the window or door by utilizing a key lock type arrangement.

U.S. Pat. No. 4,325,203 to Wicks sets forth a patio door and guard system preventing unauthorized entry through the door.

U.S. Pat. No. 4,478,002 to English sets forth a grid member mounted to an interior surface of a window panel latched relative thereto affording protection.

U.S. Pat. No. 4,384,428 to Cox and U.S. Pat. No. 4,604,827 to Hitchins are further examples of permanent type guards for mounting relative to windows and ostensibly doors.

As such, it may be appreciated that there continues to be a need for a new and improved door shield construction as set forth by the instant invention which addresses both the problems of ease of use as well a effectiveness in construction providing temporary securement of the shield to an exterior surface of a door and in this respect, the present invention substantially fulfills this need.

SUMMARY OF THE INVENTION

In view of the foregoing disadvantages inherent in the known types of shield apparatus now present in the prior art, the present invention provides a door shield construction wherein the same is arranged for temporary securement to an exposed door surface to afford protection to that surface during a construction procedure. As such , the general purpose of the present invention, which will be described subsequently in greater detail, is to provide a new and improved door shield construction which has all the advantages of the prior art shield apparatus and none of the disadvantages.

To attain this, the present invention provides a door shield arranged for securement to an exterior surface of a dwelling door to afford temporary protection to the door during construction procedures thereabout. The organization includes a polymeric rear layer mounting an accordion pleated forward surface formed of parallel ribs to afford impact resistance to the door. Magnetic and adhesive members are coextensively formed at a rear perimeter of the door for adherence of the structure to the door.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved door shield construction which has all the advantages of the prior art shield apparatus and none of the disadvantages.

It is another object of the present invention to provide a new and improved door shield construction which may be easily and efficiently manufactured and marketed.

It is a further object of the present invention to provide a new and improved door shield construction which is of a durable and reliable construction.

An even further object of the present invention is to provide a new and improved door shield construction which is susceptible of a low cost of manufacture with regard to both materials and labor, and which accordingly is then susceptible of low prices of sale to the consuming public, thereby making such door shield constructions economically available to the buying public.

Still yet another object of the present invention is to provide a new and improved door shield construction which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 8 is an enlarged isometric illustration of the insert panel utilized by the modified construction as set forth in FIGS. 6 and 7.

FIG. 9 is a further modified aspect of the insert plate utilized by the invention, as depicted in FIG. 6.

DESCRIPTION OF THE PREFERRED EMBODIMENT

Figure 1:
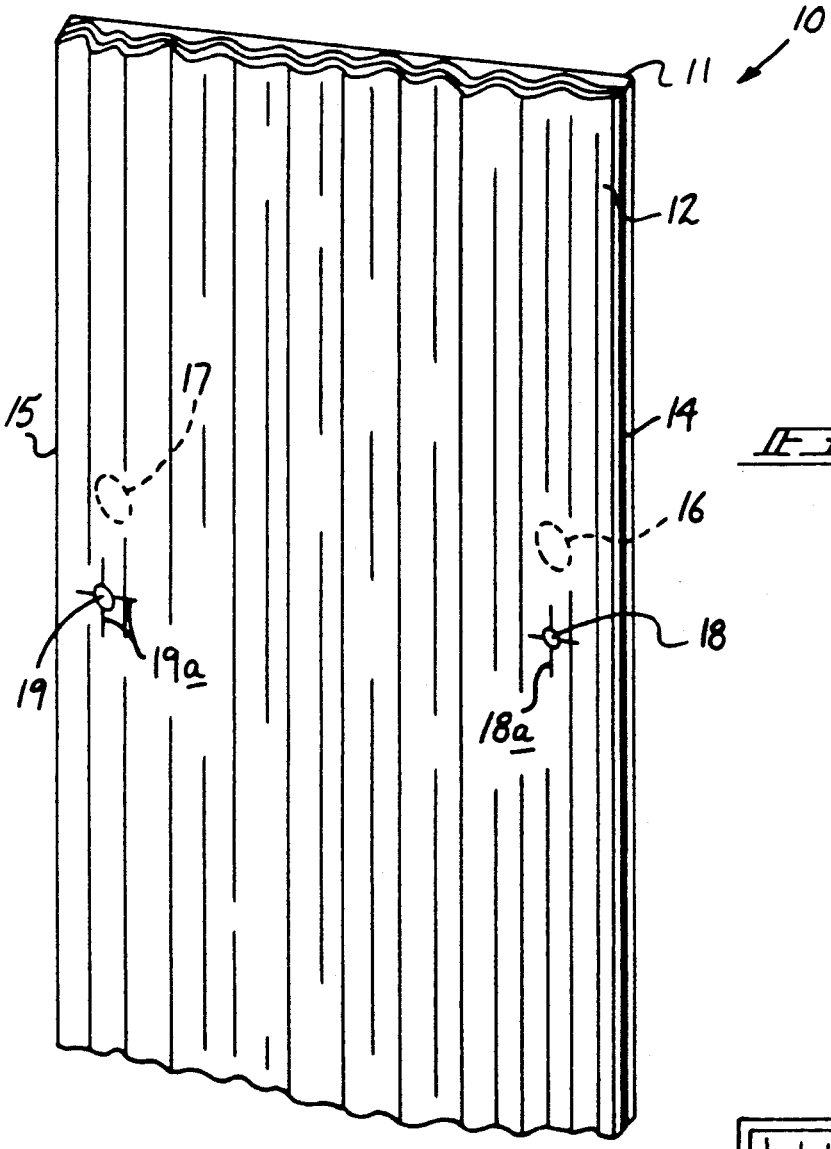
FIG. 1 is an isometric illustration of the instant invention.
Figure 2:
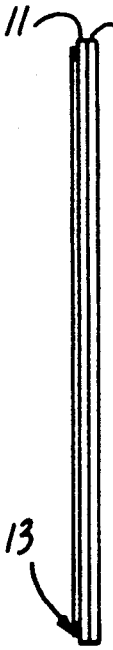
FIG. 2 is a side view of the invention, taken in elevation.
Figure 3:
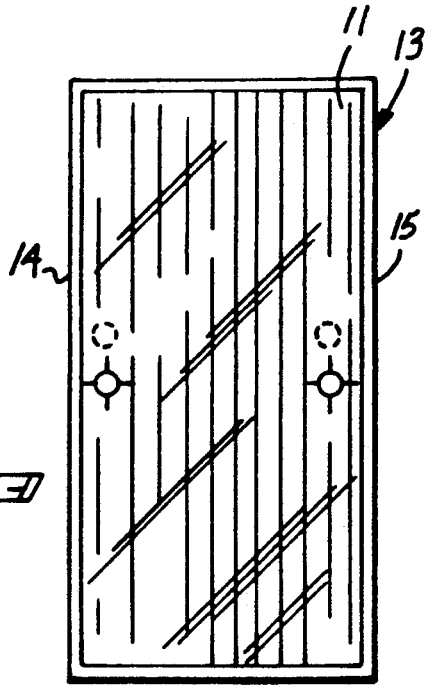
FIG. 3 is an orthographic rear view of the invention.

With reference now to the drawings, and in particular to FIGS. 1 to 9 thereof, a new and improved door shield construction embodying the principles and concepts of the present invention and generally designated by the reference numerals 10, 10*a*, and 10*b* will be described.

More specifically, the door shield construction 10 of the instant invention essentially comprises a polymeric foam web 11, including an accordion fold layer 12 mounted coextensively to a forward surface of the web 11, wherein the layer 12 is defined by parallel rib members fixedly secured to the forward surface of the web 11. The web and layer 11 and 12 defined respective right and left edges 14 and 15, wherein the web 11 includes a continuous securement strip 13 mounted to the rear surface perimeter of the polymeric foam web 11. Adjacent the respective right and left edges 14 and 15 are respective right and left cylindrical perforations 16 and 17 to provide respective right and left knock-out portions to accommodate a door knob. Both knock-out portions are required as both right and left opening doors are available. Positioned below and adjacent each respective right and left cylindrical perforations 16 and 17 is a respective right and left bore 18 and 19. Each bore includes radial slots 18*a* and 19*a* respectively radially directed exteriorly of the respective bores 18 and 19 and each of the right and left slots are arranged orthogonally relative to one another to provide accommodation of a door knob therethrough in an alternative manner relative to the cylindrical perforations 15 and 16 to provide a more rapid mounting of the panel about a door knob.

Figure 4:
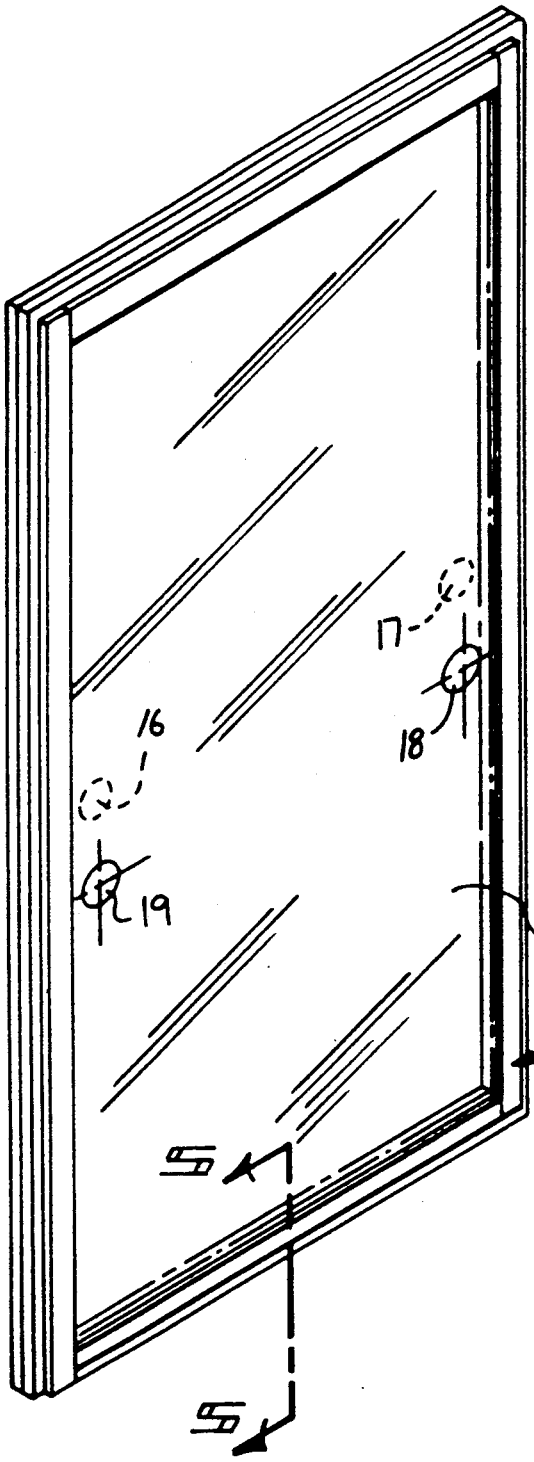
FIG. 4 is an isometric view of a modified aspect of the instant invention.
Figure 5:
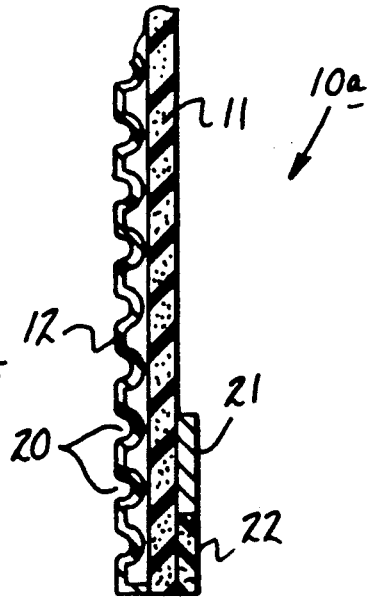
FIG. 5 is an orthographic view, taken along the lines 5—5 of FIG. 4 in the direction indicated by the arrows.

FIGS. 4 and 5 illustrate the use of modified rib structure, wherein each of the ribs of the fold layer 12 includes rib cavities 20 to provide intermediate projections to more readily accommodate flexure of each of the ribs in the event of impact to the accordion fold layer 12. Further, the modified door construction 10*a* utilizes a magnetic strip 21 mounted coextensively adjacent an adhesive strip 22 to provide selective securement means of the continuous securement strip 13. In this manner, the magnetic strip permits immediate adherence to a ferromagnetic door surface, whereas the adhesive strip 22 accommodates non-ferromagnetic door members.

Figure 6:
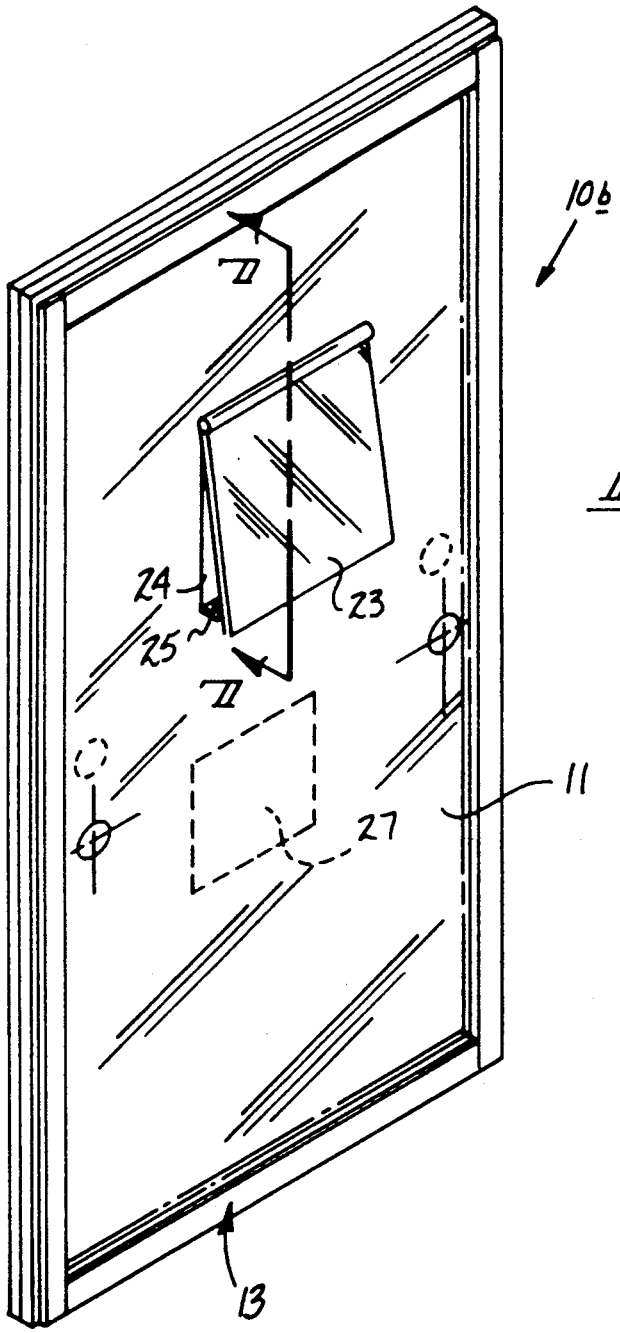
FIG. 6 is a further modified aspect of the instant invention.
Figure 7:
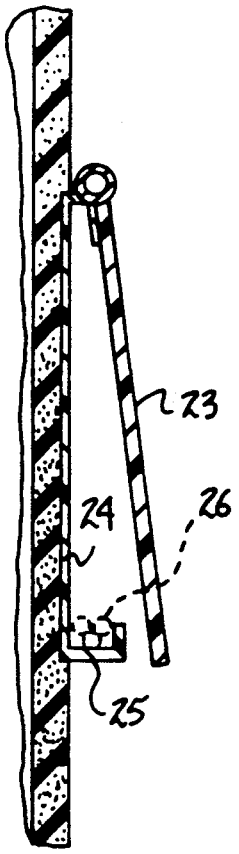
FIG. 7 is an orthographic view, taken along the lines 7—7 of FIG. 6 in the direction indicated by the arrows.

The further modified construction 10*b* as set forth in FIGS. 6 and 7 utilizes a writing pad 23 pivotally mounted to an upper terminal end of a mounting plate 24. A lower terminal end of the mounting plate includes an "L" shaped storage lip 25 for securement of writing instruments 26 thereon as further providing a ledge for mounting construction permits, construction directions, and the like. The writing pad 23 accommodates instruction by an owner or a foreman at the job site and the writing pad and associated mounting plate structure is positioned to the rear surface of the web 11 to afford protection and access to the writing pad 23 and "L" shaped storage lip 25, as well as affording protection thereto. An insert plate 27 is mounted to the rear surface of the web 11 below the mounting plate and utilizes adhesive numerals 28 for securement to the exterior surface of the accordion fold layer 12 to provide address enumeration of the door as covering of the door by the construction 10*b* will frequently provide such addressed numerals. In this manner, the adhesive address numbers 28 are removably mounted to a non-adhesive gloss surface 29 defined by the insert plate 27 removably mounting the adhesive address numbers thereon for the removal and subsequent adherence to the exterior surface of the accordion fold layer 12 providing address enumeration to ensure continuous delivery of mail, visitors, and the like at a construction site.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A door shield construction, comprising in combination, a polymeric foam web, the web including a web forward surface and a web rear surface, and an accordion pleated fold layer including vertical parallel ribs mounted coextensively to the web forward surface, and the web rear surface including a continuous securement strip fixedly mounted to the rear surface of the perimeter thereof, and the web and the layer including a right edge and a left edge, and the right edge including a right cylindrical perforation directed through the web and the fold layer adjacent the right edge, and further including a left cylindrical perforation directed through the web and the fold layer adjacent the left edge.

2. A door shield as set forth in claim 1 further including a right bore positioned below the right cylinder, the right bore including a plurality of radial slots directed exteriorly and radially of the right bore spaced apart ninety degrees relative to one another, and a left bore positioned below the left cylindrical perforation, including a plurality of further radial slots radially directed into the left bore, wherein the radial slots are spaced apart ninety degrees relative to one another.

3. A door shield as set forth in claim 2 wherein each of the parallel rib members includes spaced rib cavities coextensively formed along each rib to define alternating rib cavities and projections to accommodate impact.

4. A door shield as set forth in claim 3 wherein the securement shield includes a magnetic strip positioned adjacent and contiguously to an adhesive strip, wherein the magnetic strip permits adherence to ferromagnetic door members, and wherein the adhesive strip permits securement to alternative door surfaces.

5. A door shield as set forth in claim 4 including a mounting plate mounted to the web rear surface, the mounting plate including a writing pad hingedly mounted to an upper edge of the mounting plate, wherein the writing pad is arranged for accommodating construction directions and the like thereon, and the mounting plate including an "L" shaped storage lip formed to a lower terminal end of the mounting plate to accommodate writing instruments and construction permits thereon.

6. A door shield as set forth in claim 5 including an insert plate mounted to the web rear surface below the mounting plate, wherein the insert plate includes a matrix of adhesive numerals removably mounted to the insert plate, wherein the insert plate includes a non-adhering gloss surface to permit ease of removal of the adhesive address numerals thereto for securement of the numerals to the fold layer.

* * * * *